US006549872B2

(12) United States Patent
Bollweg et al.

(10) Patent No.: US 6,549,872 B2
(45) Date of Patent: Apr. 15, 2003

(54) METHOD AND APPARATUS FOR FIRING SIMULATION

(75) Inventors: Karsten Bollweg, Breman (DE); Anton Galhuber, Breman (DE)

(73) Assignee: STN Atlas Electronik GmbH, Bremen (DE)

( * ) Notice: Subject to any disclaimer, the term of this patent is extended or adjusted under 35 U.S.C. 154(b) by 0 days.

(21) Appl. No.: 09/907,601

(22) Filed: Jul. 19, 2001

(65) Prior Publication Data

US 2002/0045999 A1 Apr. 18, 2002

(30) Foreign Application Priority Data

Oct. 13, 2000 (DE) ..... 100 50 691

(51) Int. Cl.[7] ..... G01B 11/02

(52) U.S. Cl. ..... 702/158; 702/107; 434/21; 434/22

(58) Field of Search ..... 702/158, 107; 434/22, 11, 16, 19, 21; 463/5; 356/5.05, 141.1

(56) References Cited

U.S. PATENT DOCUMENTS 3,832,791 A 9/1974 Robertsson ..... 434/22
4,478,581 A * 10/1984 Goda ..... 434/22
4,577,962 A 3/1986 de Guillenschmidt et al. ... 356/5.05
4,854,595 A 8/1989 Eichweber ..... 463/5
4,959,016 A * 9/1990 Lawrence ..... 434/22

FOREIGN PATENT DOCUMENTS

| | | |
|---|---|---|
| DE | 3543647 | 6/1987 |
| DE | 3543698 | 6/1987 |
| DE | 19912093 | 9/2000 |

* cited by examiner

*Primary Examiner*—John Barlow
*Assistant Examiner*—Stephen J. Cherry
(74) *Attorney, Agent, or Firm*—Venable; Norman N. Kunitz

(57) ABSTRACT

A first laser beam is transmitted through the actuation of the gun trigger, the trajectory of the virtual projectile is calculated, and the deviations of the trajectory from the target direction at the firing time are determined. The first laser beam is pivoted corresponding to the trajectory deviations, and the transit time of the laser pulses of the first laser beam reflected by the target is measured, and used to determine the target range. For this target range, the trajectory of the fired virtual projectile is calculated, and compared to the time that has passed between the firing time and the reception of the reflected laser pulses. If the two match within a tolerance range, a second laser beam comprising encoded laser pulses is transmitted in the transmission direction of the first laser beam, which is received at the target, where the impact damage is calculated.

21 Claims, 6 Drawing Sheets

METHOD AND APPARATUS FOR FIRING SIMULATION

CROSS-REFERENCE TO RELATED APPLICATION

The present application claims the right of foreign priority of German Application No. DE 100 50 691.7, filed Oct. 13, 2000, the subject matter of which is incorporated herein by reference.

BACKGROUND OF THE INVENTION

The invention relates to a method and an apparatus for simulating a shot fired from a gun that fires ballistic projectiles at a target, preferably an earth-bound, moving or standing target.

In a known apparatus for firing simulation, referred to as a two-way simulator (DE 22 62 605 A1), and utilizing a practice firing device operating with laser pulses, a laser pulse transmitter is secured to the barrel of the gun and its transmitted laser-pulse sequence reaches a target through the manual aiming of the gun at the target by a gunner. If the gunner perceives the aiming process as correct, he actuates the trigger of the gun. This initiates an automatic process in which a transmitter control switches on the laser transmitter for a duration of a few milliseconds. The laser pulses impact reflectors disposed on the target, from where they are reflected onto a position-sensitive detector on the gun barrel. A range calculator calculates the target range from the transit time of the reflected laser pulses. An angular-position calculator simultaneously determines the angular deviation between the bore axis of the barrel and the center of gravity of the reflected laser radiation. A flight-time calculator determines the theoretical projectile flight time. Over the course of the projectile flight time, the laser transmitter transmits a further laser-pulse sequence, and the angular-position calculator recalculates the angular deviation between the bore axis and the center of gravity of the laser radiation.

A range calculator uses the target range and type of ammunition to calculate the correct range setting. In accordance with this correct setting, a point-of-burst position calculator uses the elevation-angle course of the target at the beginning and end of the projectile flight, the elevation aiming angle of the barrel at the time of firing and the range, to calculate the angle of elevation of the point of burst or point of impact. Analogously, the azimuth-angle course of the target at the beginning and end of the projectile flight, the lateral-pivot angle of the barrel at the time of firing and the range, are used to calculate the lateral position of the point of burst.

The point-of-burst position calculator is connected to an encoder that is programmed with respect to the type of weapon and ammunition, and is connected to the range calculator. The encoder controls the laser transmitter such that the transmitter transmits a second, encoded laser-pulse sequence that differs from the first laser-pulse sequence, and contains information about the range, the lateral and elevation-related deviations of the point of burst, and the type of ammunition and weapon. This laser-pulse sequence impacts a detector disposed on the target, to which an impact receiver, a decoder and an impact-data calculator are connected. The impact-data calculator uses the transmitted information to determine whether the weapon was effective in terms of the type of ammunition used, and calculates the effect of the detonation through a comparison between the expansion of the target in the firing direction and the deviation of the point of burst in the lateral and elevation directions.

It is the object of the invention to provide a method for firing simulation of the type mentioned at the outset, which permits larger ranges while adhering to the guidelines for visual detectability of the used laser, and also does not fail when the weapon fires at a group of closely-clustered targets. Moreover, an apparatus for firing simulation that operates in accordance with the method is intended to be produced inexpensively.

SUMMARY OF THE INVENTION

The above object is achieved according to a first aspect of the invention, by a method for simulating a shot fired from a gun for ballistic projectiles at a target, preferably an earthbound, moving or standing target, which comprises: aiming a sight, whose line of sight extends parallel to the bore axis of the gun, at the target with a setting of a horizontal course (lead) and a vertical course (elevation) of the line of sight from the target; then manually activating a trigger on the gun to initiate a simulated firing of the gun by transmitting a first laser beam including a plurality of laser pulses corresponding to a fictively fired projectile; calculating a trajectory of the fired fictively projectile; continuously determining the deviations of the trajectory from the instantaneous line-of-sight orientation at the firing time; pivoting the first laser beam by pivot-angle values that correspond to the trajectory deviations; measuring the transit time of the laser pulses reflected by the target and using the transit times to determine the target range (r); comparing either the time that has passed between the firing time and the reception of the reflected laser pulses to the flight time of the fired virtual projectile calculated for the target range (r), or comparing the actual pivot-angle values of the first laser beam relative to the instantaneous line-of-sight orientation at the firing time, with the actual pivot angle values being associated with the target range (r), to the theoretical pivot-angle values of the first laser beam relative to the instantaneous line-of-sight orientation at the firing time, with the theoretical pivot angle values having been calculated from the trajectory data for the target range (r); if the compared values match within a tolerance range, transmitting a second laser beam comprising encoded laser pulses in the transmission direction last traversed by the first laser beam, with the encoding of the second laser beam containing information about firing data of the gun, including the type of ammunition and weapon, and the identity of the gunner; and, when the second laser beam is received by one of a plurality of detectors distributed over the surface of the target, calculating impact damage from the position of the receiving detector on the target.

The above object is achieved according to a further aspect of the invention by an apparatus for simulating a shot fired from a gun for ballistic projectiles at a target, preferably an earthbound, moving or standing target, which apparatus comprises: a gun having a sight whose line of sight is permanently set parallel to the bore axis of the gun, and a trigger for initiating the fictively fired projectile; a laser transmitter, which is fixedly coupled to the gun, for transmitting a first laser beam comprising laser pulses, and a second laser beam comprising encoded laser pulses, with a temporal offset and in the same direction as the first laser beam; a control unit, which is activated by the trigger, and upon being activated, causes the laser transmitter to transmit the first laser beam; a detector that is permanently connected to the gun for receiving the laser pulses of the first laser beam that are reflected at the target; a transit-time measuring element, which is disposed downstream of the detector, for measuring the transit time of the reflected laser pulses of the first laser beam; a range calculator for calculating the target range (r) from the transit time; a trajectory calculator, which is connected to the range calculator, for calculating trajectory data of the fictively fired projectile; a plurality of detectors that are distributed over the target surface and configured to receive the second laser beam; and evaluation electronics, which are connected to the detectors, for calculating impact damage; a deflection apparatus for pivoting the transmission direction of the laser beams connected to the trajectory calculator. When the first laser beam is transmitted, the trajectory calculator continuously calculates the deviation of the trajectory from the instantaneous line-of-sight orientation at the firing time, and supplies the calculated deviation as control signals to the deflection apparatus, which pivots the first laser beam by pivoting angles ($\alpha_z$, $\alpha_x$) relative to the instantaneous line-of-sight orientation at the firing time, with the angles corresponding to the control signals. The trajectory calculator either calculates the flight time of the fictively fired projectile for the target range (r) calculated by the range calculator, and compares it to the time that has passed between the firing time and the reception of the reflected laser pulses of the first laser beam, or uses the trajectory data to calculate the theoretical pivot angles of the first laser beam relative to the instantaneous line-of-sight orientation at the firing time, and compares the calculated pivot angles to the actual pivot angles ($\alpha_z$, $\alpha_x$) of the first laser beam relative to the instantaneous line-of-sight orientation at the firing time, and if the compared angles match within a tolerance range, the trajectory calculator generates an activation signal for transmitting the second laser beam in the transmission direction last traversed by the first laser beam.

The method of the invention, as well as the apparatus of the invention, has the advantage that measuring the target with local resolution is omitted, in addition to range measurement, so no complex, locally-resolving detector or laser scanner is required on the gun barrel. The target is measured solely with respect to its range from the gun—with moderate precision—and not additionally with respect to the precise target position. The local information lies directly in the impact point of the second laser beam, which has been corrected in elevation and lead. In the case of a target cluster, that is, a plurality of targets located close together, the problem of target separation that occurs in a local resolution of the target is eliminated, and in the pure range measurement, only a slight measuring imprecision occurs, which only leads to minor errors of secondary significance. The second laser beam, comprising encoded laser pulses, always impacts where the fictively fired or virtual projectile also impacts, so the target resolution of the target field itself is performed naturally. The elimination of the necessity to perform a local measurement of the target simplifies the apparatus for firing simulation, and makes it considerably less expensive to produce.

The apparatus of the invention for firing simulation is compatible with 1-way codes and 1-way passive systems having a corresponding detector arrangement, because, unlike in the known 2-way simulator, no target courses of the point of burst must be transmitted to the target. To this point, the apparatus of the invention has been the only multipath simulator for large firing ranges for the internationally-employed MILES (Multiple Integrated Laser Engagement System) code.

Because only the first laser beam must traverse twice the target range, the attainable range is only limited by the power of the laser used for the second laser beam comprising encoded laser pulses, the laser preferably being designed for a wavelength of 905 nm in order to be compatible with existing systems, such as MILES, and its power being limited by the limit for visual detectability. The laser generating the first laser beam, in contrast, can be designed independently of the laser of the second laser beam, and have a particularly visually-detectable wavelength, for example in a range between 1500 and 1800 nm. The limit for visual detectability is therefore about 15,000 times higher than at the wavelength around the aforementioned 905 nm. The laser power can be correspondingly high. In the use of such a high-power, visually-detectable laser, the otherwise standard plurality of reflectors on the target can be omitted, which has a favorable effect on the manufacturing costs of the firing-simulation apparatus.

Advantageous embodiments of the method according to the invention, with advantageous modifications and embodiments of the invention, are disclosed. Moreover, advantageous embodiments of the apparatus according to the invention, with advantageous modifications and embodiments likewise are disclosed.

According to an advantageous embodiment of the invention, the deviations of the trajectory from the instantaneous line-of-sight orientation, the so-called target direction, at the firing time, and the derived pivoting-angle values for the first laser beam, are determined in the vertical or elevation direction. Only if a spin behavior, that is typical for the selected ballistic projectile, is to be taken into consideration in a refined trajectory calculation, are the deviations of the trajectory from the target direction at the firing time determined in azimuth. Pivoting-angle values for the pivoting of the first laser beam are also determined in the horizontal direction from the deviations.

According to another advantageous embodiment of the invention, in the use of a laser transmitter with two separate lasers for generating the two laser beams, the beam cross section of the laser is selected such that the surface on the target that is illuminated by the first laser beam is significantly larger than the surface illuminated by the second laser beam. Hence, it is only necessary to provide one reflex-reflector unit on the target, the unit having, for example, four reflex reflectors that are disposed in pairs diametrically opposite one another, and cover a 360° angle with their receiving sectors. The divergence of the first laser beam for the range measurement is minimized for a high radiation density at the target to permit large ranges.

If, in accordance with a further embodiment of the invention, a plurality of reflex reflectors is mounted on the target in the manner of a belt, the divergence is selected such that, with a predetermined minimum range, the first laser beam that illuminates the target at an arbitrary location impacts at least one reflex reflector. Whether it is necessary to use reflex reflectors is a function of the type of laser used to generate the first laser beam. With the 1500-nm diode lasers that are currently available, the power is inadequate to permit ranges of 4000 m or more without reflex reflectors. With high-power Er:glass lasers or Raman-shifted Nd:YAG lasers, however, the reflex reflectors can be omitted, because the diffuse reflection of the target is sufficient. The omission of the costly reflex reflectors has the potential to reduce costs significantly. In this case, the divergence of the first laser beam is made very small in order to attain high intensities at the target. The divergence of the first laser beam can be smaller than that of the second laser beam. The advantage of the small divergence is that only a few interfering reflections occur due to objects located in the immediate vicinity of the target, such as trees, shrubs, etc.

According to yet another advantageous embodiment of the invention, the gun-side detector that is fixedly connected to the barrel has receiving optics, whose receiving divergence is at least as great as the deflection range of the laser beams that is caused by the deflection apparatus. As an alternative, the detector can have adjustable receiving optics, whose receiving divergence corresponds to the effective beam cross section of the first laser beam, i.e., the cross section of the illuminated surface on the target, and the receiving optics are coupled to the deflection apparatus such that it is pivoted by the same pivoting angles as the first laser beam. The advantage of this alternative embodiment is an improved S/N ratio, because the receiving divergence can be selected to be smaller. A drawback is the higher opto-mechanical outlay.

A highly-sensitive avalanche photodiode or a PIN diode having a bandpass filter can be used as a detection element in the detector. The narrow receiving angle and the large laser wavelength permit a very sensitive range measurement.

With low range requirements, or with the provision of more reflex reflectors on the target, according to an advantageous embodiment of the invention, the two laser beams can be generated with a single laser, whose visually-detectable wavelength is preferably at 905 nm in order to be compatible with other systems. Because of the small beam diameter, as stipulated by power and target precision requirements, a large number of reflex reflectors is required for larger targets. As an alternative to reflex reflectors, the laser beam can be scanned in azimuth.

The invention is described in detail below by way of an embodiment of an apparatus for firing simulation, which is illustrated in the drawings.

DETAILED DESCRIPTION OF THE PREFERRED EMBODIMENTS

Figure 1:
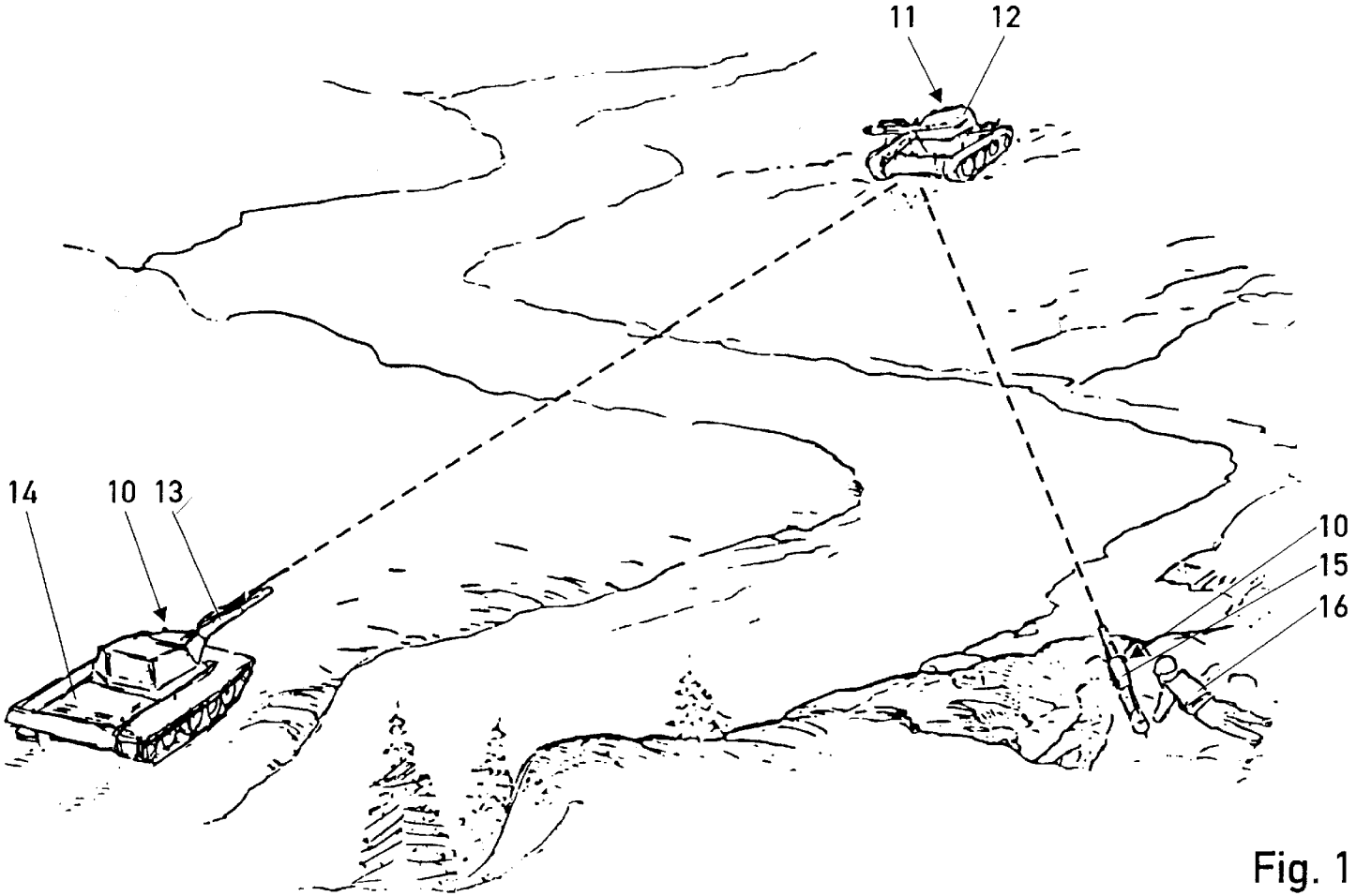
FIG. 1 a positional image of a section of terrain, with a tactical situation during a practice skirmish.
Figure 2:
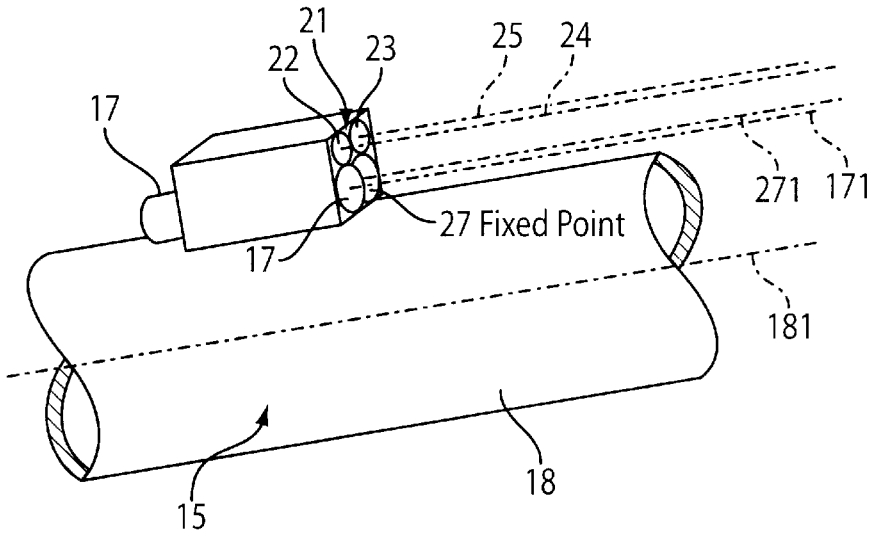
FIG. 2 is a cutout, schematic, perspective representation of a barrel of a gun having a sight and a laser transmitter, and a detector of an apparatus for firing simulation.

FIG. 1 illustrates a segment of terrain with a tactical situation during a practice skirmish, in which personnel are to practice aiming and firing a gun 10 at a target 11. A combat tank 12 serves as a moving target 11. The gun 10 to be fired at the tank 12 is realized in the example by the tank gun 13 of a second combat tank 14 or an anti-tank weapon 15 operated by a hidden gunner 16. As shown in FIG. 2, a sight 17, which is permanently coupled to the barrel 18 of the gun 10 such that the line of sight 171 of the sight 17 is oriented parallel to the bore axis 181 of the barrel 18, aids in aiming the gun 10 at the target 11. FIG. 2 is a schematic, cutout view showing the barrel 18 of the anti-tank gun 15, on which the sight 17 is directly disposed. The line of sight 171 and the bore axis 181 are indicated in a dot-dash line.

The firing of the gun 10 is simulated by the transmission of a laser radiation at the target 11, which is effected with the actuation of a trigger 19 (FIG. 3) or another firing initiator, by the gunner in the combat tank 14, or the gunner 16. With a correct orientation of the gun 10, the laser radiation impacts the target 11. A firing-simulation apparatus, which has a component 201 (FIG. 3) that is mounted on the gun 10 and a component 202 (FIG. 4) that is mounted on the target 11, serves to generate the simulated shots. Because a combat tank 12 or 14 is both actively firing and being fired at in a practice skirmish, it simultaneously constitutes the gun 10 and the target 11, so it is usually equipped with the two components 201, 202 of the firing-simulation apparatus A purely passive target 11, however, is only equipped with the target-side component 202, while an exclusively active gun 10 is only equipped with the gun-side component 201.

Figure 3:
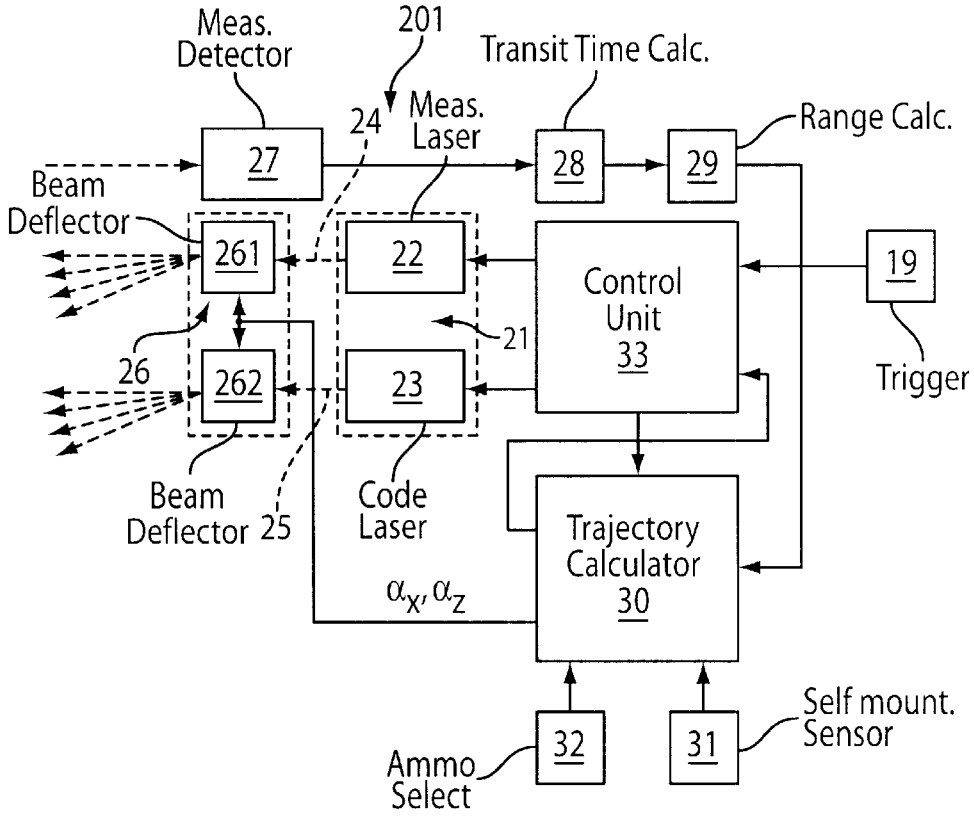
FIG. 3 is a circuit diagram of the gun-side portion of the firing-simulation apparatus.

The gun-side component 201 of the firing-simulation apparatus shown in the circuit diagram of FIG. 3 has a laser transmitter 21, which is permanently connected to the barrel 18 (FIG. 2) and has two separate lasers 22, 23. The first laser 22 is referred to hereinafter as the measurement laser, and has a wavelength in the range between 1500 and 1800 nm, and the second laser 23, referred to hereinafter as the code laser 23, has a wavelength of 905 nm. The measurement laser 22 is used to generate a first laser beam 24 comprising laser pulses, and the code laser 23 is used to generate a second laser beam 25 comprising encoded laser pulses. The details of the laser-pulse generation and the encoding of the pulses in the laser transmitter 21 are not depicted. A high-power Er:glass laser or a Raman-shifted Nd:YAG laser, for example, is used as the measurement laser 22. The divergence of the first laser beam 24 is selected to be very small. The advantage of this is that no or only small interfering reflexes are produced at the target, and reflex reflectors can be omitted at the target. The divergence of the laser beam 24 of the measurement laser 22 can be even smaller than that of the code laser 23. The second laser beam 25 of the code laser 23 has a nearly circular beam profile, with the diameter of the effective beam cross section of the second laser beam 25, that is, the diameter of the surface illuminated on the target 11, corresponding to about 1.5 times the mutual spacing of detectors disposed at the target 11, which detectors will be described in greater detail below.

The two laser beams 24, 25 always have the same transmission direction at the time of transmission. A deflection apparatus 26 pivots this transmission direction from an initial position, in which it extends parallel to the line of sight 171, as indicated in a dashed line in FIG. 3. In the process, when the first laser beam 24 is pivoted. The transmission direction of the second laser beam 25, which is transmitted with a temporal offset, can be synchronously co-pivoted; the transmission direction of the second laser beam 25 can be abruptly switched to the last transmission direction of the first laser beam 24 before the second laser beam 25 is transmitted. The deflection apparatus 26 can be realized, for example, as two pivoting mirrors 261, 262, which are coupled to one another and can be respectively adjusted in azimuth and elevation by an adjusting drive. A laser beam 24 or 25 is guided by a respective pivoting mirror 261, 262. As an alternative, electro-optical or acousto-optical deflectors can be used for beam deflection.

The gun-side component 201 of the firing-simulation apparatus further includes a detector 27 for receiving the first laser beam 24 of the measurement laser 22, which is reflected at the target 11. The detector referred to hereinafter as the measurement detector 27, which is provided for distinguishing between the target-side detectors, can be a highly-sensitive avalanche photodiode or a PIN diode having a bandpass filter. The measurement detector 27 is permanently connected to the barrel 18 of the gun 10, so its optical axis 271 is oriented parallel to the bore axis 181 (FIG. 2). The receiving divergence of its receiving optics is dimensioned to be as large as the maximum deflection of the laser beams 24, 25 from its initial position, as effected in elevation and possibly in azimuth by the deflection apparatus 26. As an alternative, the receiving optics of the measurement detector 27 can be coupled to the deflection apparatus 26 such that its optical axis is pivoted synchronously with the first laser beam 24. In this case, the receiving optics have a receiving divergence that corresponds to the effective beam cross section of the first laser beam 24, i.e., the surface on the target 11 that is illuminated by the first laser beam 24.

A transit-time measuring element 28 and a range calculator 29 are disposed downstream of the measurement detector 27. These components 28 and 29 are typically combined to form range-measurement electronics. The transit time of the reflected laser pulses of the first laser beam 24 are determined in the transit-time measuring element 28, for which purpose the length of time from the transmission of a laser pulse to the reception of the reflected, identical laser pulse is measured and divided in half. The transmission frequency of the laser pulses of the measurement laser 22 is selected such that the time interval between successively-transmitted laser pulses is considerably larger than the transit time of the laser pulses from transmission to reception with a maximum range. The range calculator 29 calculates the target range r from the transit time of the reflected laser pulses.

Figure 5:
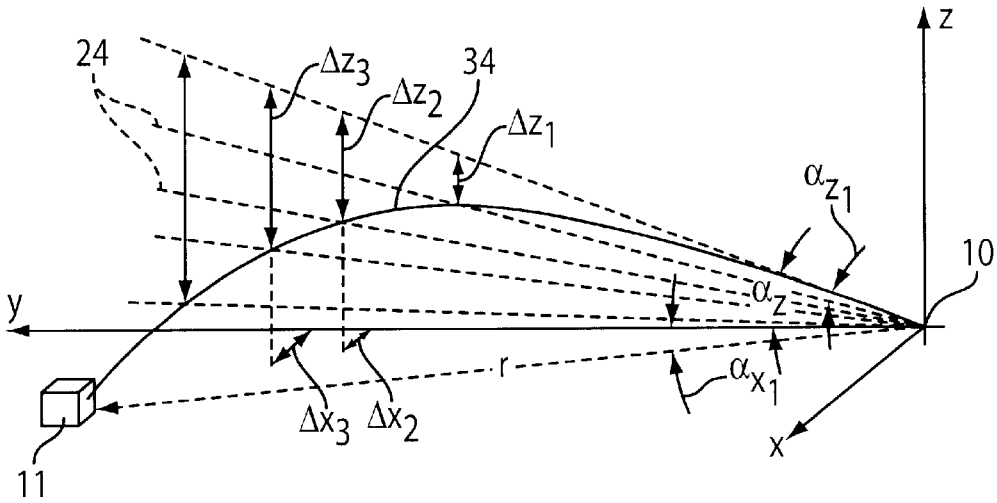
FIG. 5 is an exemplary representation of a trajectory of a virtual projectile fired from the firing-simulation apparatus at a target.

The gun-side component 201 of the firing-simulation apparatus further includes a trajectory calculator 30, which is connected, on the input side, to the range calculator 29, a self-movement sensor 31, an ammunition selector 32 and a control unit 33, and, on the output side, the deflection apparatus 26 and the control unit 33. The control unit 33 is connected on the input side to the trigger 19 of the gun 10, and, on the output side, controls the laser transmitter 21 and the trajectory calculator 30. The trajectory calculator 30 serves to calculate the trajectory of a projectile selected by the ammunition selector 32, with consideration of the orientation of the barrel 18 in azimuth and elevation, that is, the position of the barrel 18 at the time of the fictitious firing of the ballistic projectile. FIG. 5 illustrates such a trajectory 34 in a three-dimensional coordinate system x, y, z, with the gun 10 being disposed in the coordinate origin. The trajectory calculator 30 also calculates the deviations $\Delta z$ of the trajectory 34 from the instantaneous orientation of the line of sight 171 of the sight 17 by the gunner, referred to hereinafter as the target direction, at the time that the gunner fires the simulated shot in elevation—specifically as a pivot angle $\alpha_z$ of an imaginary straight line drawn from the coordinate origin through the respective trajectory point relative to the target direction at the firing time. The trajectory calculator 30 uses the deviations to generate control signals for the deflection apparatus 26. If a spin inherent to the real ballistic projectile is to be factored in, the trajectory calculator 30 additionally calculates the deviations $\Delta x$ of the trajectory 34 in azimuth from the target direction at the firing time, specifically as a pivot angle $\alpha_x$ of the imaginary straight line drawn from the coordinate origin through the second trajectory point relative to the target direction at the firing time. The trajectory calculator 30 also uses the deviations to generate control signals for the deflection apparatus 26.

To compensate a self-movement of the gun 10, more precisely of the barrel 18, in the time between the initiation of the simulated shot and the impact of the target 11 with the first laser beam 24, which can be effected, for example, through further panning of the moving target 11 by the gunner with the sight 17, the self-movement detector 31 detects the self-movement components of the barrel 18 in elevation and azimuth as deviations of the line of sight 171 from the target direction at the firing time, e.g., using a single- or dual-axis gyroscope. The control signals for the deflection apparatus 26 that have been generated from this in the trajectory calculator 30 are corrected in the trajectory calculator 30 with the data supplied by the self-movement sensor 31, so the target direction is kept constant.

Figure 4:
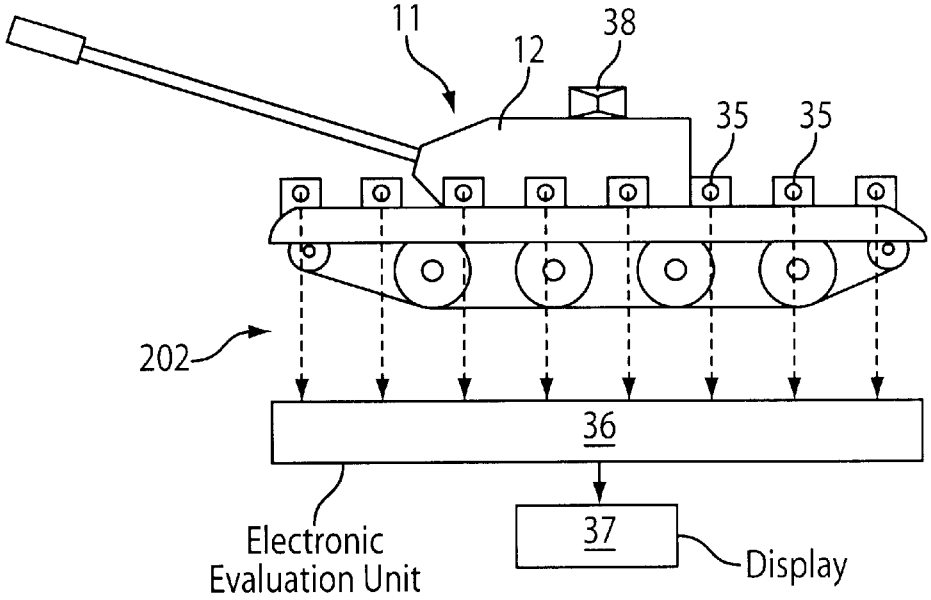
FIG. 4 is a side view of a combat tank serving as a target, with the target-side portion of the firing-simulation apparatus shown as a circuit diagram.

The target-side component 202 of the simulation apparatus illustrated in FIG. 4 includes a plurality of detectors 35, which are distributed over the surface of the target 11 and are configured to receive the encoded laser pulses of the second laser beam 25 transmitted by the code laser 23. In the embodiment of the target 11 as a combat tank 12, the detectors 35 surround the tank 12 horizontally in the manner of a belt, with the detectors 35 being spaced virtually equidistantly from one another. The detectors 35 are connected to evaluation electronics 36 for decoding the information transmitted by the code laser 23, and for calculating impact damages, which are then displayed in a display unit 37. In certain applications, a reflex-reflector unit 38 is also disposed on the target 11. This reflex-reflector unit 38 comprises a plurality of reflex reflectors, which, in this case, are offset from one another by 90° circumferential angles and cover a 360° angle with their receiving sectors.

Figure 6:
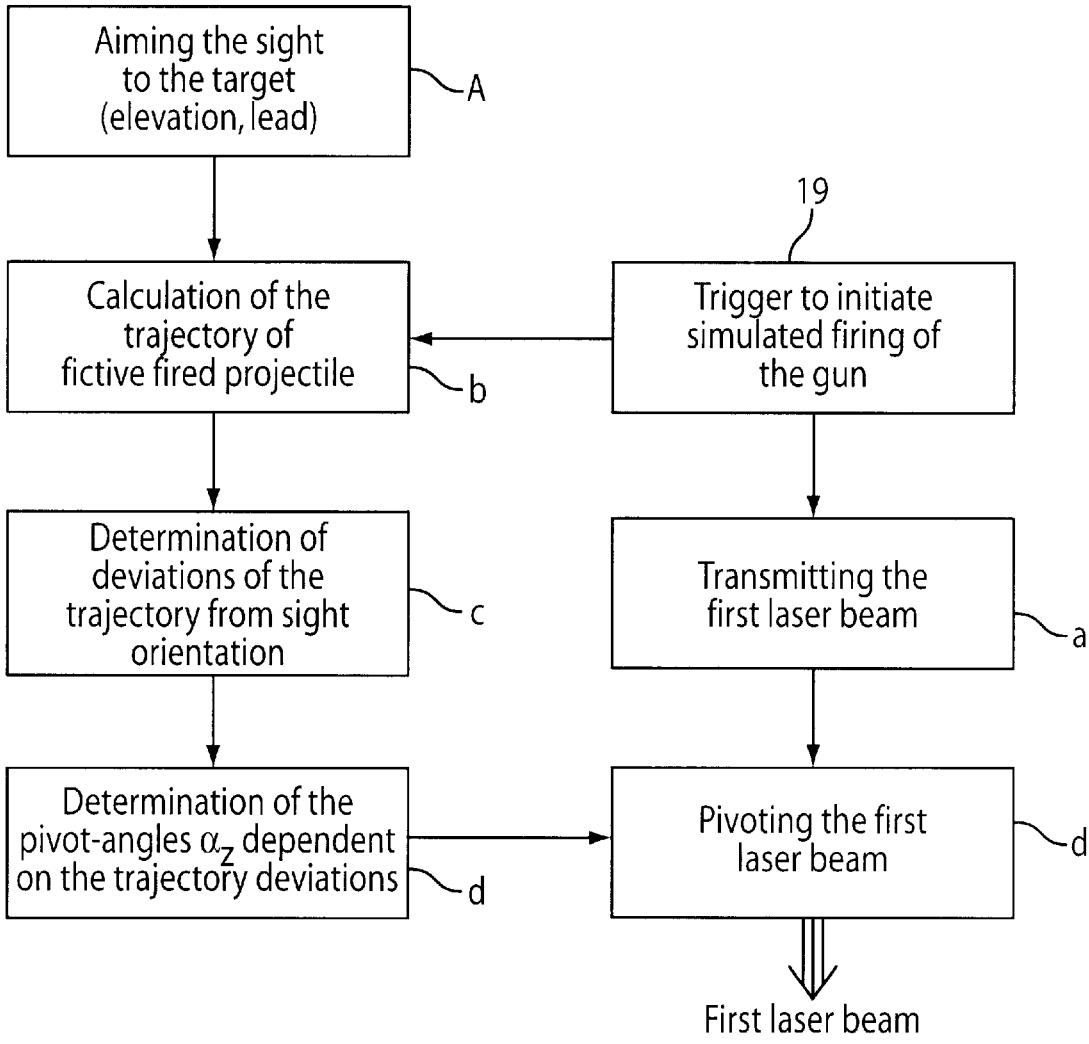
FIGS. 6–8 are a floor diagram of the method according to the invention.
Figure 7:
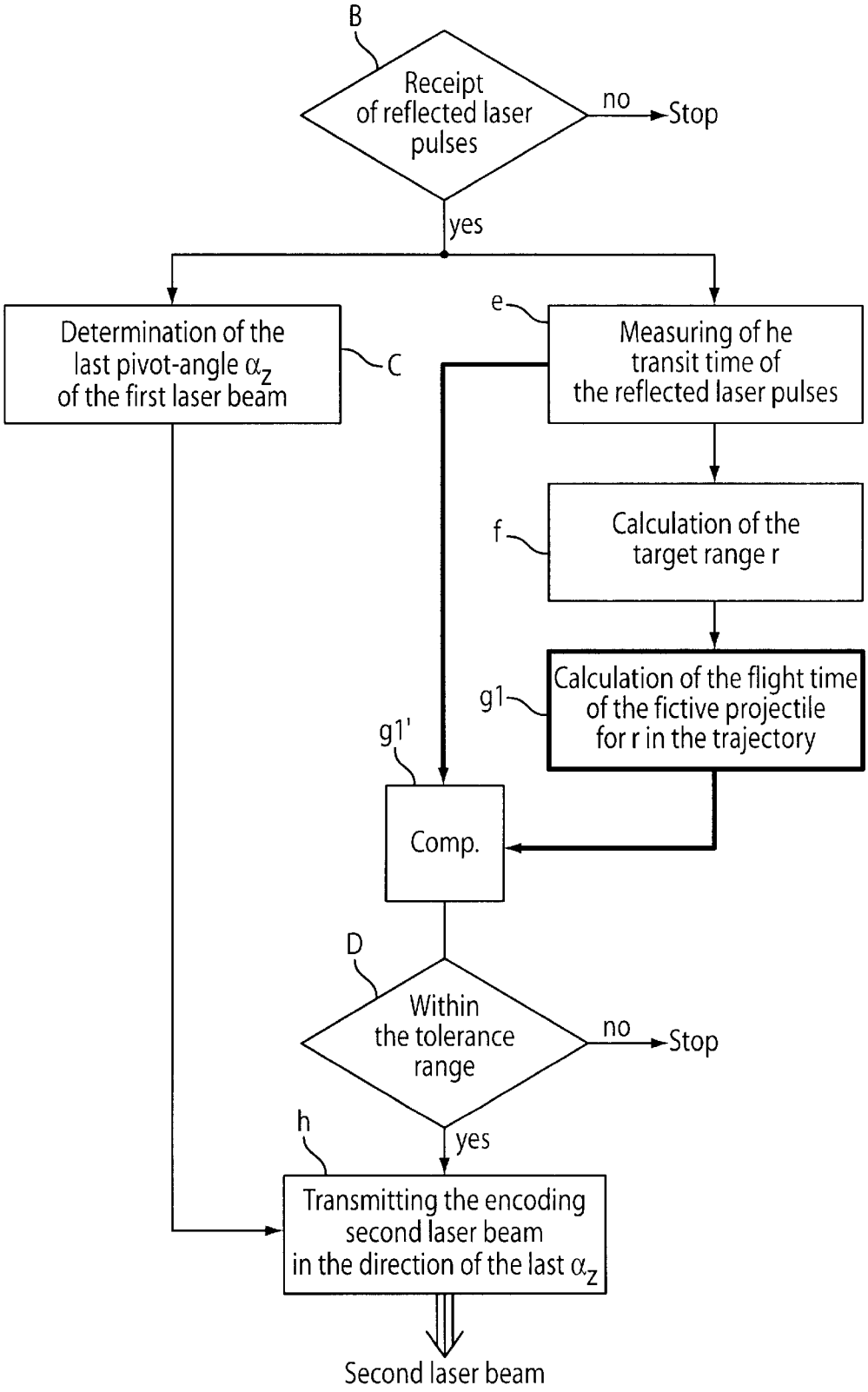
Figure 8:
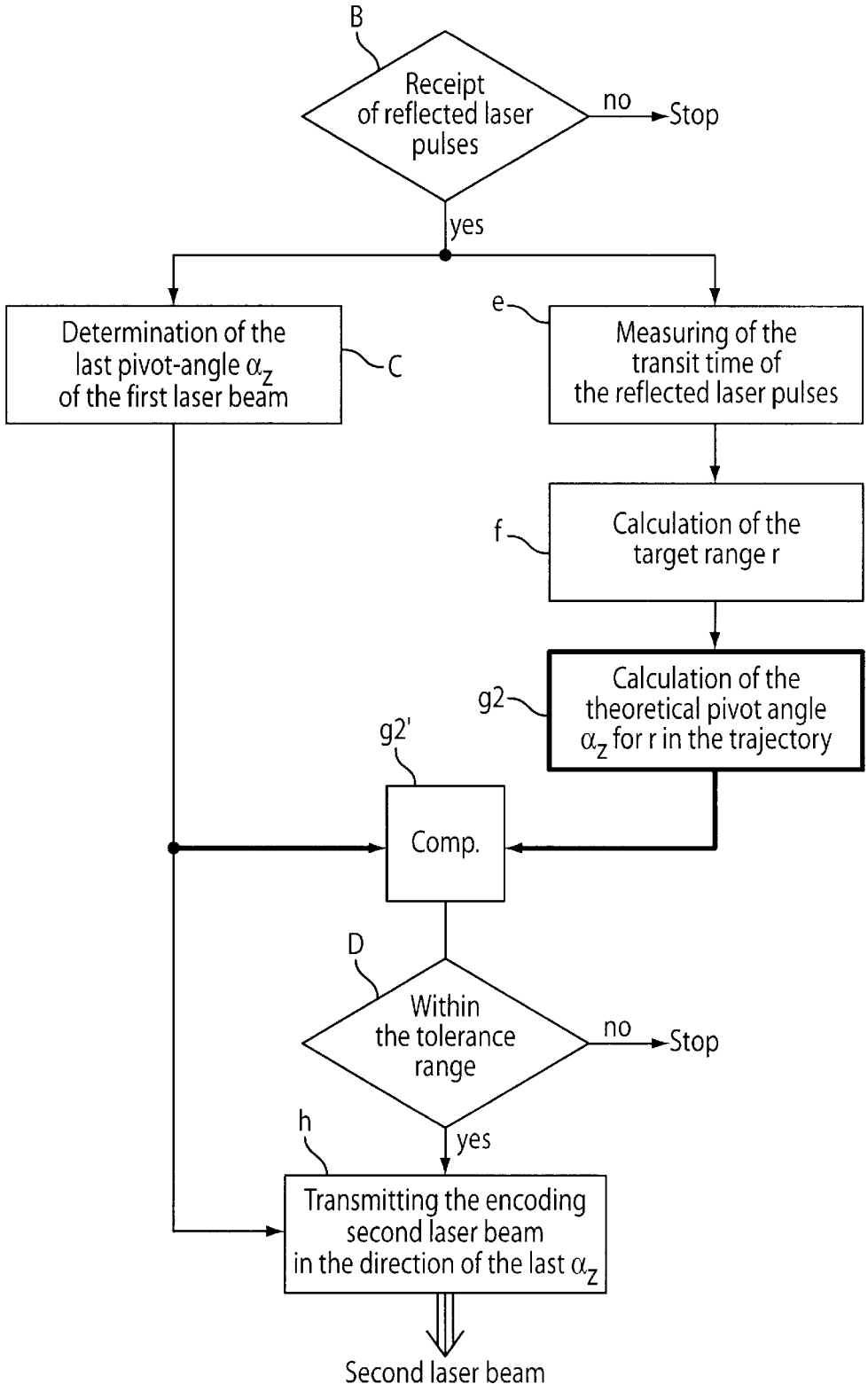

The above-described firing-simulation apparatus, with its gun-side component 201 and its target-side component 202, operates in accordance with the following method illustrated in FIGS. 6–8:

After the sight 17 of the gun 10 has been oriented toward the target 11, with the line of sight 171 being displaced, relative to the target point, by a lead and elevation (horizontal and vertical course of the line of sight 171 from the target 11) estimated by the gunner 16 (FIG. 6, A), the gunner actuates the trigger 19. The control unit 33 registers this action, and activates the laser transmitter 21 (FIG. 6, *a*) and the measurement laser 22 here, on the one hand, and, on the other hand, the trajectory calculator 30 (FIG. 6, *b*). The measurement laser 22 transmits the first laser beam 24 comprising laser pulses.

At the same time, the trajectory 34 of the fictively fired or virtual projectile is calculated in the trajectory calculator 30 (FIG. 6, *b*), corresponding to the orientation of the sight 17, and thus of the barrel 18, at the firing time for the selected type of projectile, and the ballistic deviation $\Delta z$, and possibly the lateral deviation Ax (FIG. 5), of the trajectory 34, is or are continuously determined from the target direction at the firing time (FIG. 6, *c*). As described above, the trajectory calculator 30 assesses these deviations as pivot angles $\alpha_z$ in elevation and possibly $\alpha_x$ in azimuth, and uses them to generate control signals that are supplied to the deflection apparatus 26. Corresponding to these control signals, the deflection apparatus 26 pivots the first laser beam 24 of the measurement laser 22 continuously downward, as shown in FIG. 5 for different times during the flight time of the virtual projectile (FIGS. 6, *d* and $d^1$).

If the laser beam 24 impacts the target 11 during the flight time, the laser pulses are reflected at the target 11 and received by the measuring detector 27 (FIGS. 7 and 8B). The transit time of the reflected laser pulses is measured (transit-time measuring element 28) FIGS. 7 and 8, *e*), and the target range r is determined from the transit time (range calculator 29) (FIGS. 7 and 8, *f*). In the trajectory calculator 30, the theoretical pivot-angle values of the first laser beam 24 relative to the target direction at the firing time, the values resulting from the trajectory data for the measured target range r, are calculated and compared (FIGS. 8, $g^2$_and $g2^1$) to the actual pivot-angle values $\alpha_z$ and possibly $\alpha_x$ of the first laser beam 24 relative to the target direction at the firing time, the values being associated with the target range r. The laser beam 24 actually has these values at the time that it impacts the target 11 (FIGS. 7, and 8, C).

As an alternative, the flight time of the virtual projectile, as is necessary for the measured target range r, is calculated in the trajectory calculator 30, and the measuring detector 27 compares the determined flight time to the time that has passed since the shot was initiated (FIGS. 7, $g^1$ and $g1^1$). In other words, the time from the firing time, i.e., the first transmission of the laser signals of the first laser beam 24 is compared to the time of reception of the laser pulses of the first laser beam 24 being reflected for the first time at the target 11. If these values match within a tolerance range (FIGS. 7 and 8, D), the control unit 33 activates the code laser 23, which thereby transmits the second laser beam 25, specifically in the same transmission direction in which the measurement laser 22 points (FIGS. 7 and 8, *h*). The encoding of the second laser beam 25 contains information about the type of projectile and weapon, and the identity of the gunner. If the gunner has aimed the gun 10 fairly correctly at the target 11 in terms of lead and elevation, the laser pulses of the second laser beam 25 will impact one of the detectors 35 of the target 11. The evaluation electronics 36 uses the position of the impacted detector 35 on the target 11, and the decoded information transmitted with the laser pulses and decoded in the evaluation electronics 36, to assess the damage to the target 11. The firing simulation ends with the transmission of the second laser beam 25 by the code laser 23, and the control unit 33 shuts off the trajectory calculator 30, so the supply of control signals to the deflection apparatus 26 ends and the deflection apparatus 26 returns to its initial position, and the transmission directions of the lasers 22, 23 are again oriented parallel to the line of sight 171.

The invention is not limited to the described embodiment of the firing-simulation apparatus. For example, the aforementioned reflex-reflector unit 38 (FIG. 4) can additionally be provided at the target 11 for increasing the range of the measurement laser 22, or for decreasing the power of the measurement laser 22 with the same range. In this case, the beam cross sections of the two laser beams 24, 25 are selected such that the surface on the target 11 that is illuminated by the first laser beam 24 is significantly larger than the surface illuminated by the second laser beam 25. The dimensions of the surface illuminated by the first laser beam 24 are then slightly larger than the horizontal dimension of the largest target 11, and slightly larger than twice the vertical dimension of the target 11 at the permissible minimum range. If currently-available diode lasers are used, such a reflex-reflector unit 38 is absolutely required if ranges of 4000 m or more are desired.

With low range requirements, the two temporally-offset laser beams 24, 25 can be generated with a single laser, which operates with a visually-detectable wavelength of 905 nm in order to be compatible with other systems of a combat-field practice center. The opto-electrical outlay for the transmitter is lower, but only relatively small ranges can be realized for the range measurement due to requirements related to visual detectability regulations. For larger ranges, a plurality of reflex reflectors at the target 11 is imperative in addition to the reflex-reflector unit 38. The divergence of the laser beam is then selected such that, with a permissible minimum target range, the laser beam illuminating an arbitrary location on the target 11 impacts at least one reflex reflector.

For a more precise calculation of the trajectory 34 with large target elevation angles, i.e., a considerable raising of the bore axis 181 relative to the horizontal, for example, a target elevation angle of about 20°, the set target elevation angle is measured by a suitable sensor and incorporated into the trajectory calculation. In the same manner, a tilting of the gun 10 can be detected and factored into the trajectory calculation.

The invention now being fully described, it will be apparent to one of ordinary skill in the art that many changes and modifications can be made thereto without departing from the spirit or scope of the invention as set forth herein.

What is claimed is:

1. A method for simulating a shot fired from a gun for ballistic projectiles at a target, preferably an earthbound, moving or standing target, comprising: aiming a sight, whose line of sight extends parallel to a bore axis of the gun, at a target with a setting of a horizontal course (lead) and a vertical course (elevation) of the line of sight from the target; and then manually activating a trigger on the gun to initiate a simulated firing of the gun by the following steps:

a) transmitting a first laser beam including a plurality of laser pulses;

b) calculating a trajectory of a projectilefictively fired by the gun c) continuously determining deviations of the trajectory from the instantaneous line-of-sight orientation at the firing time;

d) pivoting the first laser beam by pivot-angle values that correspond to the trajectory deviations;

e) measuring a transit time of the laser pulses that are reflected by the target and f) using in the transit time to determine the target range (r);

g1) either comparing the time that has passed between the firing time and the reception of the reflected laser pulses to the flight time of the fictively fired projectile calculated for the target range (r), or g2) comparing actual pivot-angle values of the first laser beam relative to the instantaneous line-of-sight orientation at the firing time, with the actual pivot-angle values being associated with the target range (r), to the theoretical pivot-angle values of the first laser beam relative to the instantaneous line-of-sight orientation at the firing time, with the theoretical pivot-angle values having been calculated from the trajectory data for the target range (r);

h) if the compared values match within a tolerance range, transmitting a second laser beam comprising encoded laser pulses is transmitted in the transmission direction last traversed by the first laser beam, with the encoding of the second laser beam containing information about firing data of the gun, including the type of ammunition and weapon, and the identity of the gunner;

i) and at the target, when the second laser beam is received by at least one detector disposed on the surface of the target, calculating impact damage from the position of the receiving detector on the target.

2. The method according to claim 1, wherein: a plurality of the detectors are distributed over the surface of the target; and said step of calculating impact damage includes calculating the damage from the position of the respective receiving detectors on the surface of the target.

3. The method according to claim 1, wherein the deviations ($\Delta z$) of the trajectory from the instantaneous line-of-sight orientation at the firing time, and the pivot-angle values ($\alpha_z$) of the first laser beam that have been derived from the deviations, are determined in elevation.

4. The method according to claim 3, wherein the deviations ($\Delta x$) of the trajectory from the instantaneous line-of-sight orientation at the firing time, and the pivot-angle values ($\alpha_x$) of the first laser beam that have been derived from the deviations, are additionally determined in azimuth.

5. The method according to claim 1 wherein deviations of the line of sight from the instantaneous line-of-sight orientation at the firing time are measured continuously and used to correct the pivot-angle values ($\alpha_z$, $\alpha_x$) of the first laser beam.

6. The method according to claim 1 wherein a single laser having a visually-detectable wavelength, is used for transmitting the respective first and second laser beams with a temporal offset, and a plurality of reflex reflectors is provided on the target.

7. The method according to claim 1 wherein two separate lasers are used to transmit the respective first and second laser beams with a temporal offset.

8. The method according to claim 7 wherein the first and second laser beams are bundled such that the first laser beam illuminates a significantly larger surface on the target than the second laser beam, and a reflector unit is provided on the target for full-azimuth reception.

9. The method according to claim 7 wherein a high-power laser generates the first laser beam, and the divergence of the first laser beam is selected to be very small.

10. The method according to claim 7 wherein a radiation profile of the second laser beam is dimensioned such that the surface on the target that is illuminated by the second laser beam corresponds to about 1.5 times the mutual spacing of the detectors on the target.

11. An apparatus for simulating a shot fired from a gun for ballistic projectiles at a target, preferably an earthbound, moving or standing target, said apparatus comprising: a gun having a sight whose line of sight is permanently set parallel to a bore axis of the gun, and a trigger for initiating a fictively fired projectile; a laser transmitter, which is fixedly coupled to the gun, for transmitting a first laser beam, comprising laser pulses, and a second laser beam, comprising encoded laser pulses, with a temporal offset and in the same direction as the first laser beam; a control unit that is selectively activated by the trigger, and upon being activated, causes the laser transmitter to transmit the first laser beam; a first detector, which is permanently connected to the gun, for receiving the laser pulses of the first laser beam reflected at the target; a transit-time measuring element, which is disposed downstream of the first detector, for measuring the transit time of the reflected laser pulses of the first laser beam; a range calculator for calculating the target range (r) from the transit time; a trajectory calculator, which is connected to the range calculator, for calculating trajectory data of the fictively fired projectile; a plurality of second detectors, which are distributed over the target surface and configured to receive the second laser beam; evaluation electronics, which are connected to the second detectors, for calculating impact damage; a deflection apparatus for pivoting the transmission direction of the laser beams connected to the trajectory calculator, said trajectory calculator being responsive to the transmission of said first laser beam for continuously calculating the deviation of the trajectory from the instantaneous line-of-sight orientation at the firing time, and supplying the calculated deviations as control signals to the deflection apparatus to cause pivoting of the first laser beam by pivoting angles ($\alpha_z$, $\alpha_x$) relative to the instantaneous line-of-sight orientation at the firing time, with the angles corresponding to the control signals; said trajectory calculator either calculates the flight time of the fictively fired projectile for the target range (r) calculated by the range calculator, and compares it to the time that has passed between the firing time and the reception of the reflected laser pulses of the first laser beam, or uses the trajectory data to calculate the theoretical pivot angles of the first laser beam relative to the instantaneous line-of-sight orientation at the firing time, and then compares the calculated angles to the actual pivot angles ($\alpha_z$, $\alpha_x$) of the first laser beam relative to the instantaneous line-of-sight orientation at the firing time, and if the angles match within a tolerance range, generates an activation signal for transmitting the second laser beam in the transmission direction last traversed by the first laser beam.

12. The apparatus according to claim 11, wherein the trajectory calculator calculates the trajectory deviation ($\Delta z$, $\Delta x$) from the instantaneous line-of-sight orientation at the firing time, and the pivot angles ($\alpha_z$, $\alpha_x$) of the first laser beam, which have been derived from the deviations, in elevation and, if the selected projectile exhibits spin behavior, additionally in azimuth.

13. The apparatus according to claim 11, wherein the laser transmitter has a single laser with a visually-detectable wavelength, for selecting generating the first and second laser beams and a plurality of reflex reflectors is distributed over the target surface.

14. The apparatus according to claim 11, wherein the laser transmitter has a first laser with a wavelength between 1500 and 1800 nm for generating the first laser beam, and a second laser with a wavelength of 905 nm for generating the second laser beam.

15. The apparatus according to claim 14, wherein the divergence of the first and second laser beams is such that the surface on the target illuminated by the first laser beam is significantly larger than the surface illuminated by the second laser beam, and a reflex-reflector unit is disposed approximately centrally on the target for full-azimuth reception.

16. The apparatus according to claim 14, wherein a plurality of reflex reflectors is disposed on the target, and the divergence of the first laser beam is selected such that, with a permissible minimum target range (r), the first laser beam illuminating an arbitrary location on the target impacts at least one reflex reflector.

17. The apparatus according to claim 14, wherein a high-power laser is used to generate the first laser beam, and the first laser beam has a very small divergence.

18. The apparatus according to claim 14, wherein the beam profile of the second laser beam is such that the dimensions of the surface on the target that is illuminated by the second laser beam correspond to about 1.5 times the mutual spacing of the second detectors on the target.

19. The apparatus according to claim 11, wherein said first detector permanently connected to the barrel of the gun has receiving optics, whose receiving divergence is at least as large as the deflection range of the laser beams effected by the deflection apparatus.

20. The apparatus according to claim 11, wherein the first detector permanently connected to the barrel of the gun has adjustable receiving optics, whose receiving divergence corresponds to the effective beam cross section of the first laser beam, and the receiving optics are couple to the deflection apparatus such that they are pivoted by the same pivoting angles ($\alpha_x$, $\alpha_z$) as the first laser beam.

21. The apparatus according to claim 11, wherein the trajectory calculator is connected to a self-movement sensor that senses the self-movement of the gun, and the data supplied by the self-movement sensor are used to correct the control signals for the deflection apparatus in the sense of a compensation of the self-movement of the gun relative to the target orientation.

* * * * *

UNITED STATES PATENT AND TRADEMARK OFFICE

CERTIFICATE OF CORRECTION

PATENT NO. : 6,549,872 B2
DATED : April 15, 2003
INVENTOR(S) : Karsten Bollweg et al.

It is certified that error appears in the above-identified patent and that said Letters Patent is hereby corrected as shown below:

Title page,
Item [75], delete "Breman" both occurrences and insert -- Bremen --; and delete "Galhuber" and insert -- Gallhuber --.

Signed and Sealed this

Tenth Day of June, 2003

JAMES E. ROGAN
*Director of the United States Patent and Trademark Office*